US007852280B2

(12) United States Patent
Zink et al.

(10) Patent No.: US 7,852,280 B2
(45) Date of Patent: Dec. 14, 2010

(54) BROADBAND STRUCTURALLY-EMBEDDED CONFORMAL ANTENNA

(75) Inventors: Katherine Zink, Bedford, NH (US); Court Rossman, Merrimack, NH (US); Zane Lo, Merrimack, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 988 days.

(21) Appl. No.: 10/589,526

(22) PCT Filed: Mar. 3, 2005

(86) PCT No.: PCT/US2005/007400

§ 371 (c)(1), (2), (4) Date: Aug. 15, 2006

(87) PCT Pub. No.: WO2005/084406

PCT Pub. Date: Sep. 15, 2005

(65) Prior Publication Data

US 2007/0176838 A1 Aug. 2, 2007

(51) Int. Cl.
*H01Q 9/28* (2006.01)

(52) U.S. Cl. ..... 343/795

(58) Field of Classification Search ..... 343/795, 343/769, 725–728

See application file for complete search history.

(56) References Cited

U.S. PATENT DOCUMENTS

| | | | | |
|---|---|---|---|---|
| 6,028,692 | A * | 2/2000 | Rhoads et al. | 359/245 |
| 6,072,439 | A * | 6/2000 | Ippolito et al. | 343/797 |
| 6,140,972 | A * | 10/2000 | Johnston et al. | 343/725 |
| 6,317,098 | B1 * | 11/2001 | Andrews et al. | 343/797 |
| 6,329,649 | B1 * | 12/2001 | Jack et al. | 250/250 |
| 6,480,168 | B1 * | 11/2002 | Lam et al. | 343/805 |
| 6,844,851 | B2 * | 1/2005 | Yoon et al. | 343/700 MS |
| 6,844,858 | B2 * | 1/2005 | Andrews et al. | 343/726 |
| 7,369,086 | B2 * | 5/2008 | Luen | 343/700 MS |

* cited by examiner

*Primary Examiner*—Huedung Mancuso
(74) *Attorney, Agent, or Firm*—Daniel J. Long; Robert K. Tendler

(57) ABSTRACT

An antenna comprising a crossed pair of center-fed end-loaded bent-dipole radiators which are structurally embedded into a properly loaded cavity. Broadband, dual independent polarized, and hemisphere field-of-view coverage with low RCS characteristics is provided with this antenna.

8 Claims, 2 Drawing Sheets

(a) X-loop (b) Archimedean Spiral (c) Sinuous Antenna (d) Serrated-Edge Slot Antenna

BROADBAND STRUCTURALLY-EMBEDDED CONFORMAL ANTENNA

BACKGROUND OF THE INVENTION

1. Field of the Invention

The present invention relates to antennas and more particularly to structurally-embedded conformal antennas.

2. Brief Description of Prior Developments

A polarization-diverse receiving system for modern low-RCS airborne platforms requires a physically small, low profile, low RCS, broadband and dual independent polarization antenna. It is believed, however, that there is currently no such an antenna meeting all the needs that systems desire, especially over the VHF/UHF frequency spectrum due to the nature of long wavelengths over these bands.

A standard multi-polarization cross-loop (X-loop) antenna, as shown in FIG. 1(*a*), is used on similar applications when there are no RCS constraints or aerodynamic drag constraints. A couple of new types of flush-mounted and cavity-backed antennas were designed to address the aerodynamic drag. These antennas are Archimedean Spiral FIG. 1(*b*), Sinuous FIG. 1(*c*), and Serrated-edge slot FIG. 1(*d*) antenna, as shown below. These cavity-backed antennas are all loaded with lossy absorbing material to dampen the high Q resonant cavity modes.

The disadvantage of X-loop, as shown in FIG. 1(*a*), is that it has higher aerodynamic drag even with the use of an aero radome and it does not address RCS factors at all. The disadvantage of Archimedean Spiral antenna, as shown in FIG. 1(*b*), is that the linear polarization components rotate with frequency, which complicates antenna calibration on certain applications. In addition, the Spiral antenna suffers large out-of-band RCS as the density of slots result in a large impedance discontinuity between the spiral aperture and the ground plane. Although the sinuous antenna, as shown in FIG. 1(*c*), resolves the frequency-dependent linear polarization issues of the Archimedean Spiral, the density of slots still generates a significant out-of-band RCS. There are two disadvantages to the Serrated-edge slot antenna design shown in FIG. 1(*d*). The first disadvantage is that the antenna matching is solely accomplished by absorbing material thus reducing radiation efficiency. The second disadvantage is that the multiple lobes appear in the patterns at the high end of operating frequency band because the currents flow freely over the entire width of the patch. Thus, the useable operating frequency band is limited.

No existing antenna is known to be capable of providing dual independent polarization and broadband VHF/HUF operations with low RCS characteristics while the antenna is electrically small, low profile and conformal flush-mountable.

A need, therefore, exists for an antenna which overcomes the disadvantages of the prior art.

SUMMARY OF INVENTION

The antenna of the present invention comprises a crossed pair of center-fed end-loaded bent-dipole radiators which are structurally embedded into a properly loaded cavity to provide broadband, dual independent polarized, and hemisphere field-of-view coverage with low RCS characteristics. This Low Observable Broadband Structurally-Embedded Conformal Antenna (LOBSECA) is electrically small as well as low profile and it is easy to be made lightweight by composite material fabrication.

BRIEF DESCRIPTION OF THE DRAWINGS

The present invention is further described with reference to the accompanying drawings wherein.

DETAILED DESCRIPTION OF THE PREFERRED EMBODIMENT

Figure 1:
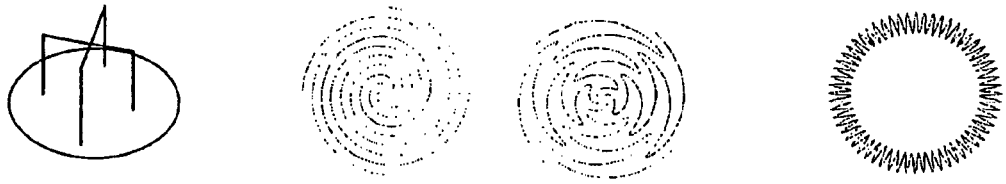
FIGS. 1(*a*), 1(*b*), 1(*c*) and 1(*d*) are schematic drawings, respectively, of a prior art X-loop antenna, Archimedian spiral antenna, sinuous antenna, and serrated-edge slot antenna.
Figure 2:
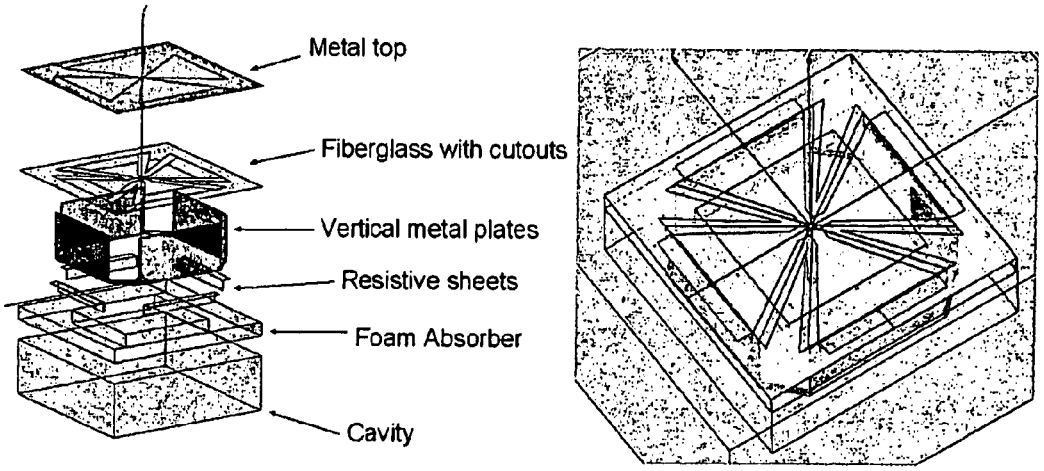
FIG. 2 is an exploded perspective view of a preferred embodiment of the. LOBSECA antenna of the present invention.

An exploded view of the LOBSECA antenna of this invention is shown in FIG. 2. The crossed radiating elements (radiators) are embedded in a ground plane, forming thin slots on the flush surface. The width of the radiators, and therefore the separation between crossed-radiators, is critical to minimizing coupling between antennas and improving radiation efficiency. It is also possible to implement the antenna with a single slot between radiators or multiple slots between radiators. The number of slots is determined by the emphasis of application on Gain or on RCS characteristics. Vertical metal elements extend the radiators into the cavity. The bent dipole-like radiator approach reduces the low frequency limit of the impedance match. The vertical elements also provide capacitive loading to the cavity and further reduce the resonant frequency of the radiators. The additional path length reduces multiple reflections from the ends of the horizontal elements providing a smooth VSWR response at the higher frequencies. The vertical elements are capacitively coupled to the horizontal elements for ease of manufacture. The ends of the vertical elements are shorted together to increase the capacitive loading and to act as a mode suppressor. For instance, at the higher frequencies a 1-wavelength resonance on one radiator can excite a cross-polarized 1-wavelength resonance on the orthogonal element. The short suppresses this coupling. The additional path length also reduces multiple reflections from the ends of the vertical elements and provides a smooth VSWR response.

Each radiator is center-fed by a balanced coaxial line in current design. However, various configurations of feed networks can be inserted depending on the desired application. Two orthogonal radiators can be combined through a 90 deg-hybrid for circular polarization or through an 180 deg-hybrid for sum and difference patterns.

A distributed lossy material, either a resistive sheet or a foam absorber, is placed near or on the outer square section. The outer slots do not contribute to the radiation efficiency and they distort the pattern shape at the higher frequencies. These outer slots are damped with lossy material for broadband performance. Distributed lossy foam is placed under the corners elements, where the diagonal slots meet the square slots. This lossy foam extends into the diagonal and reduces reflections from the discontinuities at the corners. The main radiating sections of the slot (near the center of the aperture) are kept free of absorber to maintain antenna efficiency. The high frequency impedance behavior is that of a traveling wave antenna or transmission line. Waves traveling from the feed point towards the ends of the elements are absorbed and not reflected, providing a constant or slowly varying characteristic impedance response. Reducing the high current concentration at the corner discontinuity maintains pattern symmetry.

Figure 3:
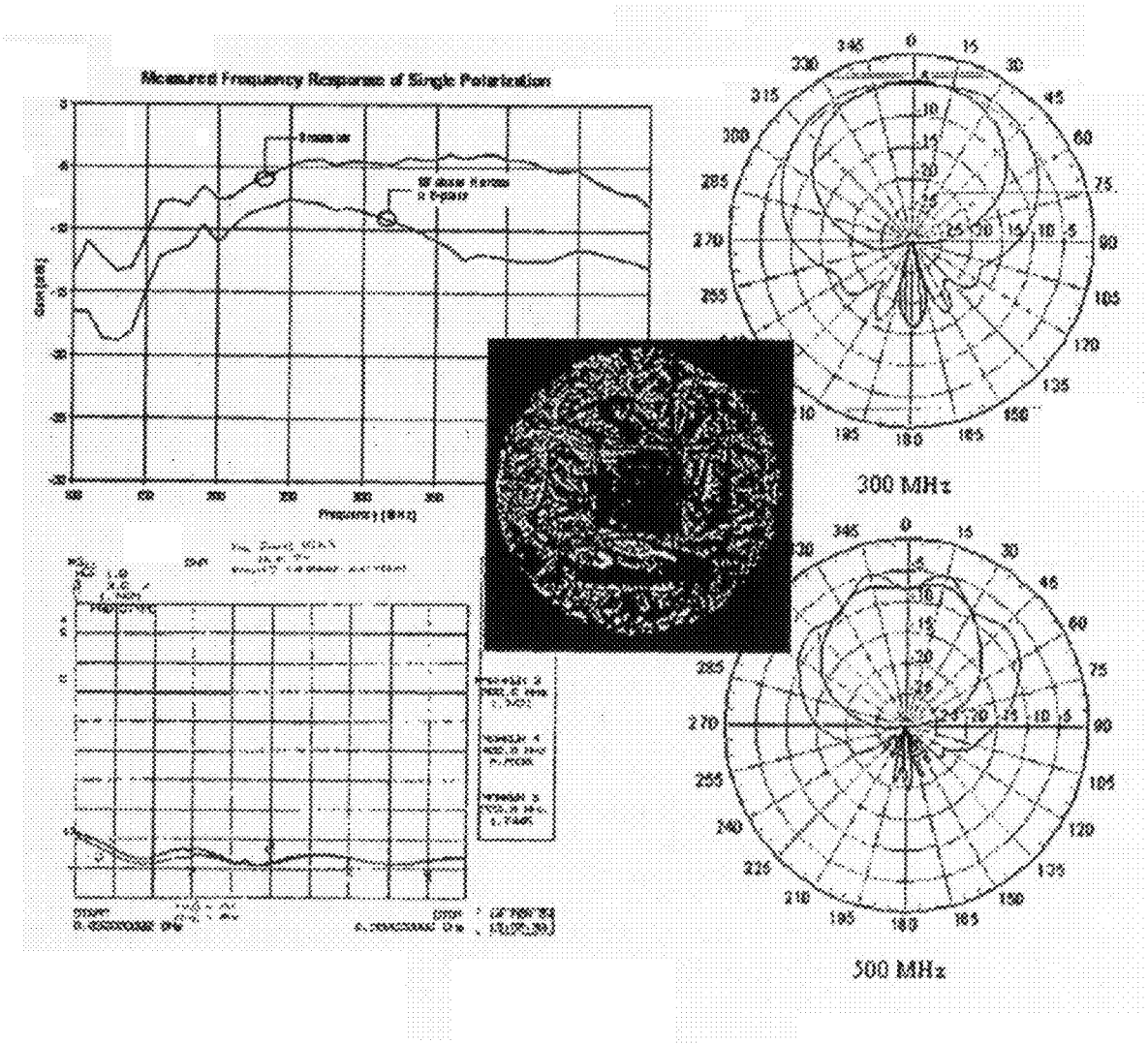
FIG. 3 are graphs showing measured antenna performance for the LOBSECA antenna shown in FIG. 2.

The antenna was installed on an 8 ft-diameter circular ground plane and measured in an anechoic tapered chamber. The antenna under test, measured VSWR for each radiator pair, gain at broadside and at 15-degree above the horizon, and the typical mid and high band radiation patterns for a single polarization radiator are shown in FIG. 3.

It will also be appreciated that for modem aircraft there are advantages to a low profile, lightweight, conformal, and structurally embeddable antenna capable of broadband operations to support the multi-function needs at an affordable cost. The LOBSCA antenna can be straightforwardly modified to satisfy the needs in commercial applications.

Those skilled in the art will appreciate that the antenna of the present invention holds several unique advantages over antennas of the prior art. There are four major advantages. The first one is that the architecture of the antenna has inherently low RCS characteristics, which is most important for the targeted next generation airborne payload. The second advantage is that the aperture is conformal flush mountable and thus eliminates air drag in military and commercial airplane applications. The third advantage is that this cavity-backed aperture is electrically small in size, low profile, and can be made lightweight by composite fabrication; therefore, it requires less real estate than typical cavity antennas. The fourth advantage is that the aperture operates efficiently over 6:1 frequency band and supports dual-linear polarizations, which can also be combined to support circular polarization applications. These four major advantages suggest that this innovative LOBSECA antenna design satisfies all the needs for next generation airborne payloads.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An antenna comprised of a crossed pair of planar center-fed end-loaded bent-dipole radiators, said dipole radiators lying in a plane, with said radiators being bent out of said plane at the distal ends thereof, said radiators being structurally embedded in a ground plane on top of a cavity having conductive sidewalls, whereby broadband, dual independent polarized, and hemisphere field-of-view coverage are provided.

2. The antenna of claim 1, wherein said ground plane is slotted, said dipole radiators comprising a bow tie antenna having planar bow tie elements located between slots in said ground plane, the distal ends of said bow tie elements spaced from said ground plane so as to form a slot between the distal end of a bow tie element and said ground plane, said bow tie antenna elements lying in a direction parallel to the plane of said ground plane; and, a plate at the distal end of each of said bow tie elements depending downwardly out of the plane of said planar bow tie element, said downwardly-depending plates lowering the low frequency cutoff of said antenna.

3. The antenna of claim 2, and further including a second bow tie antenna orthogonal to said first bow tie antenna, said second bow tie antenna having respective downwardly-depending plates at the distal ends of the bow tie elements thereof

4. The antenna of claim 2, and further including a second bow tie antenna coplanar with the first bow tie elements of said first-mentioned bow tie antenna and orthogonal thereto in a quad configuration.

5. The antenna of claim 4, wherein adjacent edges of the bow tie elements of said first and second bow tie antennas define a slot.

6. The antenna of claim 1, wherein said bent dipole radiators include a bow tie antenna.

7. The antenna of claim 6, wherein said bent dipole antenna includes a pair of crossed bow tie antennas.

8. A method for decreasing the low frequency cutoff of a broadband, low-observable, conformal antenna embedded in a cavity and having orthogonally-oriented planar bow tie elements, comprising the step of electrically coupling to the distal ends of the bow tie elements to respective downwardly-depending plates bent out of the plane of the planar bow tie elements at the distal ends thereof, the plates serving to extend the effective size of the antenna at the low frequency end thereof.

* * * * *